US007544014B1

(12) United States Patent
Bergmann

(10) Patent No.: US 7,544,014 B1
(45) Date of Patent: Jun. 9, 2009

(54) RETAINING WALL ANCHOR SYSTEM

(75) Inventor: John W. Bergmann, East Jordan, MI (US)

(73) Assignee: Redi-Rock International LLC, Charlevoix, MI (US)

( * ) Notice: Subject to any disclaimer, the term of this patent is extended or adjusted under 35 U.S.C. 154(b) by 57 days.

(21) Appl. No.: 11/623,144

(22) Filed: Jan. 15, 2007

(51) Int. Cl.
*E02D 29/02* (2006.01)

(52) U.S. Cl. ..... 405/262; 405/284; 405/286

(58) Field of Classification Search ..... 405/262, 405/284, 286
See application file for complete search history.

(56) References Cited

U.S. PATENT DOCUMENTS 4,616,959 A * 10/1986 Hilfiker ..... 405/286
4,824,293 A * 4/1989 Brown et al. ..... 405/284
5,419,092 A * 5/1995 Jaecklin ..... 405/284
5,511,910 A 4/1996 Scales
5,975,809 A * 11/1999 Taylor et al. ..... 405/262
6,019,550 A 2/2000 Wrigley et al.
6,224,295 B1 * 5/2001 Price et al. ..... 405/262
6,416,257 B1 7/2002 Rainey
6,443,662 B1 9/2002 Scales et al.
6,443,663 B1 9/2002 Scales et al.
6,457,911 B1 10/2002 Scales et al.
6,468,004 B1 * 10/2002 Price ..... 405/262
6,490,837 B1 * 12/2002 Dueck et al. ..... 52/592.6
6,536,994 B2 * 3/2003 Race ..... 405/262
6,679,656 B1 1/2004 Manthei
6,827,527 B2 * 12/2004 Conkel et al. ..... 405/284
6,884,004 B1 * 4/2005 Scales et al. ..... 405/284

* cited by examiner

*Primary Examiner*—Frederick L Lagman
(74) *Attorney, Agent, or Firm*—MacMillan, Sobanski & Todd, LLC

(57) ABSTRACT

A connection securing a geogrid fabric to between two tiers of stacked concrete blocks which form an earth retaining wall. A groove is formed in the top of each block in the lower tier to extend across the width of the block with grooves in adjacent blocks aligned. The groove is slightly wider that the rod and fabric wrapped around the rod and is deeper than its width. The fabric extends from backfill behind the wall over the groove. A rod is positioned over the fabric above the groove and pushed into the groove. A free end of the fabric wraps around the rod and extends from the groove towards the rear of the block. A wedge is positioned in the groove above the fabric and rod. When an upper tier of blocks is stacked on the lower tier, the rod and fabric are locked into the groove.

10 Claims, 4 Drawing Sheets

RETAINING WALL ANCHOR SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The invention relates to earth retaining walls constructed from precast concrete blocks, and more particularly to a connection for securing a geogrid fabric to an earth retaining wall constructed from stacked concrete blocks.

BACKGROUND OF THE INVENTION

Earth retaining walls are frequently constructed from stacked precast concrete blocks. After the blocks are stacked on a suitable foundation, the earth side of the wall is filled with backfill. The maximum height of the retaining is limited by a number of factors, including the size and weight of the blocks, the foundation for the wall, the type of backfill and surrounding earth, and drainage. It is well known that a higher retaining wall can be constructed if the wall is secured to the adjacent earth with a geogrid system.

Various types of systems have been used in the past for stabilizing concrete block earth retaining walls. In one type of system, ground anchors are embedded in the earth behind the retaining wall and are connected through cables or rods to the wall to prevent the wall from moving. In another type of geogrid system, a perforated geogrid fabric is buried in the earth behind the wall. After one or more tiers of blocks are stacked to form a portion of the wall, backfill is added behind the wall to substantially the level of the top of the stack. The fabric is laid over the backfill and over the top of the adjacent blocks. The next tier of blocks are then stacked on the wall on top of the fabric. Different types of fabric have been used in geogrid systems of this type, including metal fabrics and fabrics formed from a tough, stable synthetic resinous material. The fabric is formed with sufficient openings or perforations to allow water to freely pass through the fabric, and to help the fabric to grip the adjacent soil.

U.S. Pat. No. 6,416,257 shows a geogrid system in which a groove is formed across the top of each block to extend parallel to the face of the block. The bottoms of the blocks forming an adjacent upper tier include a projection which extends part way into the groove. A geogrid fabric is laid over the top of the blocks in a tier and an elongated flat member is inserted into the groove, forcing the fabric into the groove. When a block is positioned in an adjacent upper tier, the bottom projection pushes the elongated member in the groove to secure the geogrid fabric to the block. With this system, it may be possible for a strong force to pull the fabric from between the tiers of blocks.

U.S. Pat. No. 6,019,550 teaches a method for securing a perforated plastic fabric to concrete block earth retaining wall. The blocks are formed with vertical passages which are aligned when the blocks are stacked. Pins are inserted in the passages to prevent the blocks from shifting relative to each other in a horizontal plane. A groove is formed in the top of each block to extend parallel to the face of the block. After a tier of blocks is stacked and backfill is added behind the wall, a geogrid fabric is placed to extend over the top of the blocks and the backfill. A special anchor member is then placed in the groove on top of the fabric. The anchor member includes longitudinally spaced projections which extend through the perforations in the fabric. When the next tier of blocks is stacked on the wall, the anchor member is confined in the groove and secures the fabric to the wall. The anchor member is designed for use with blocks having a top groove sized to receive the anchor member and the fabric and having projections which have the same longitudinal spacing as the spacing between perforations in the fabric. Also, it is necessary to align the fabric with the wall blocks so that a row of perforations are positioned to receive the anchor member when the anchor member is inserted into the groove in the top of the blocks.

U.S. Pat. No. 6,679,656 discloses a method for securing a geogrid fabric to a retaining wall formed from stacked blocks. A groove is formed in the top of each block to extend generally parallel to the direction of a wall formed from the blocks. When blocks are stacked to form a lower tier, the grooves on the individual blocks align to form a continuous groove. The geogrid fabric extends from behind the tier where it will be embedded into fill behind the wall. The fabric is wrapped around a rod which is positioned in the groove towards the front of the wall. The free end of the fabric nearest the rod is folded over the rod so that it extends towards the back of the wall. The groove has a sufficient horizontal width to receive two rods and the geogrid fabric. A second rod is then laid in the groove to the rear of the first rod to extend over the fabric. An upper tier of blocks is then stacked over the lower tier so that the groove in the top of the lower tier is covered by the blocks in the upper tier. The weight of the blocks in the upper tiers retain the rods in the groove. Backfill is then added behind the upper tier of blocks to cover and anchor the geogrid fabric. Any force tending to move the retaining wall will place tension on the geogrid fabric in a direction attempting to pull the fabric from between the stacked blocks. This causes the rods to wedge more tightly in the groove to make it more difficult to pull the fabric from between the blocks.

BRIEF SUMMARY OF THE INVENTION

The invention is directed to a connection for securing a geogrid fabric to a concrete block earth retaining wall for stabilizing the wall. According to the invention, a groove is formed in the top of each block to extend across the width of the block substantially parallel to the face of the block. The groove in each block will connect with the grooves in the tops of any adjacent blocks in a tier. After blocks in a tier are positioned for constructing a wall, the area behind the wall is backfilled and the geogrid fabric is laid over the backfill and the top of the blocks so that an end of the fabric extends past the groove formed along the top of the tier. A first rod is then positioned on top of the fabric and pressed into the groove. If the grooves are longer than first rods, two or more rods are positioned end to end to extend the length of the groove. The width of the groove is only slightly larger than the diameter of the rod. The end of the fabric is folded over the rod to extend towards the back of the wall. An elongated wedge is placed in the groove above the fabric to extend above and to the front of the first rod. The next tier of blocks is then positioned on top of the previously constructed tier of blocks and the geogrid fabric. This tier of blocks closes the groove on the top of the adjacent lower tier and confines the rod and wedge to the groove. If a force attempts to move the regaining wall, pulling on the geogrid fabric, the first rod and fabric become wedged between the groove and the wedge to prevent slippage of the fabric. Accordingly, a simple construction is provided for securing a geogrid fabric to stacked blocks which form a retaining wall.

Various objects and advantages of the invention will become apparent from the following detailed description of the invention and the accompanying drawings.

DETAILED DESCRIPTION OF THE INVENTION

Figure 1:
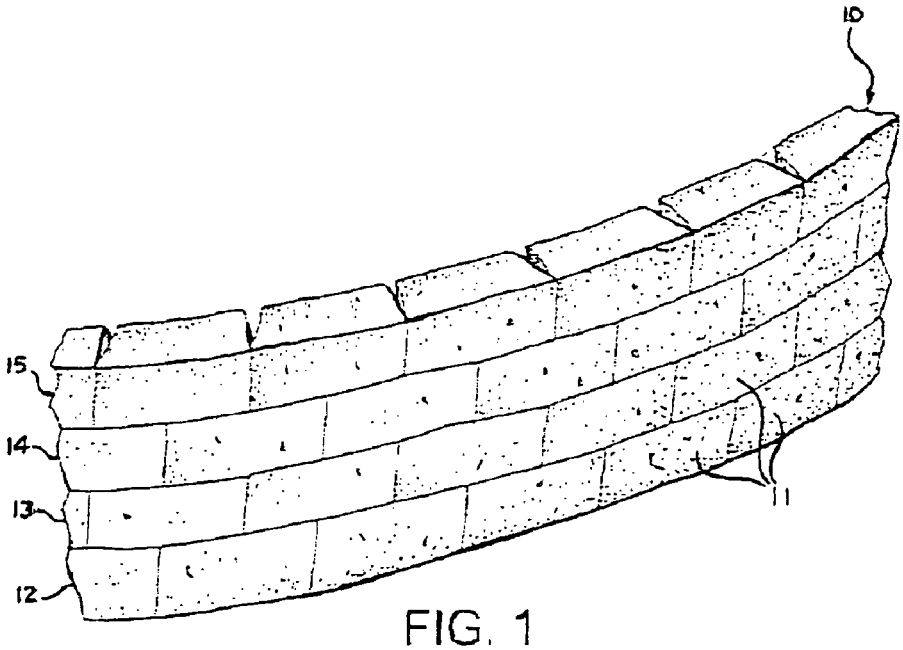
FIG. 1 is a perspective view of an exemplary four tier retaining wall formed from stacked concrete blocks.

FIG. 1 is an perspective view of an exemplary earth retaining wall 10 constructed from a plurality of precast concrete blocks 11 which are stacked in tiers to a desired height. The exemplary wall 10 has four tiers 12-15. The wall 10 may be constructed with any desired shape, for example, it may be curved, as shown, or straight or shaped to follow a desired terrain. The blocks 11 may be formed to have any desired size, provided that they are sufficiently large for constructing a stable retaining wall. An exemplary block may be about 36 to 48 inches wide by about 12 to 24 inches high by 24 to 42 inches deep.

Depending on various factors including, but not limited to, the soil type, drainage, the size and weight of the blocks 11, and the height and design of the retaining wall 10, it may be necessary to stabilize the wall with a geogrid system which forms a stabilizing connection between the retaining wall 10 and the ground behind the retaining wall. A typical geogrid system consists of a perforated fabric which is embedded in the backfill behind the wall and is secured to the wall. Various geogrid fabrics for use in stabilizing are commercially available. An exemplary geogrid fabric which may be used to stabilize the retaining wall 10 consists of a planar sheet of synthetic material which is formed into a network of integrally connected polymeric tensile elements. Apertures or perforations extend through the fabric between the tensile elements to pass water and to increase the grip which the backfill has on the fabric. The geogrid fabric either is secured to retaining wall blocks 11 or is secured between tiers of blocks forming the wall 10. In an exemplary retaining wall, a separate geogrid connection is made at every second or third tier of the wall. The location and design of the geogrid system will be determined by the needed stability of the wall. During construction of the retaining wall, the fabric is secured to the wall and is embedded in the backfill behind the wall. Spaced apertures formed in the fabric interlock with the fill material behind the retaining wall 10 to securely anchor the fabric to the earth.

Figure 2:
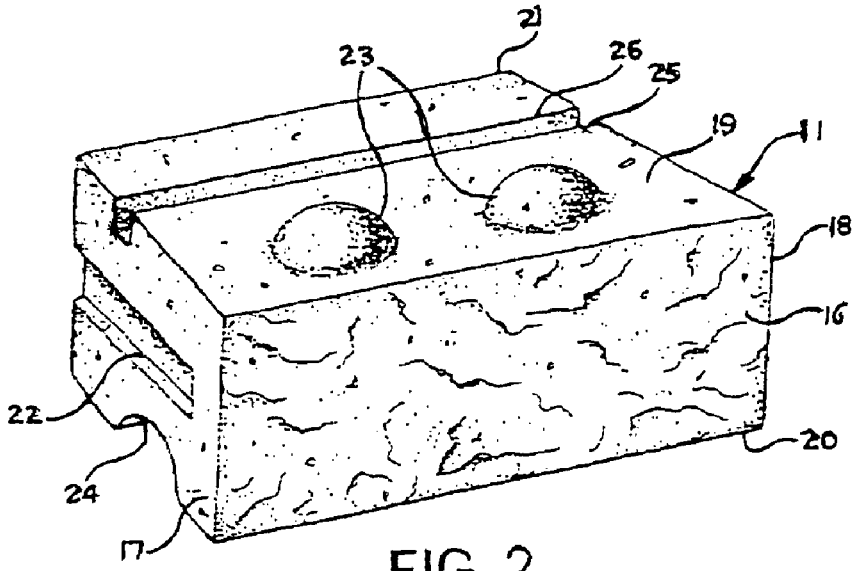
FIG. 2 is a perspective view of an exemplary block for use in the retaining wall of FIG. 1.

An exemplary precast concrete retaining wall block 11 is shown in FIG. 2. The block 11 has a face 16 which forms the exposed side of the retaining wall 10. Preferably, the face 16 is textured and, optionally, may be colored to simulate natural stone. The exemplary block 11 has left and right sides 17 and 18, a top 19, a bottom 20 and a rear 21. In plan view, the rear 20 may be shorter than the face 16, or the face 16 may be shorter than the rear 20. This permits adjacent blocks in a wall tier to be angled relative to each other to form a curving wall. If the block is trapezoidal in plan with a longer face 16, as shown in FIG. 3, an optional groove 22 may be formed in each side 17 and 18 to extend from the rear 21 to just short of the face 16 to permit lifting and moving the block 11 with a forklift.

Preferably, a known arrangement may be provided for preventing stacked blocks 11 in a tier from shifting relative to the blocks in an adjacent lower tier. For the exemplary block 11, two knobs 23 project from the top 19 equidistant from the face 16. A groove 24 is formed in the bottom of the block 11 so that when the block 11 is stacked on top of another block 11, the bottom groove 24 on the upper block receives the top knobs 23 on any adjacent lower blocks. It should be appreciated that the bottom groove 24 may be omitted from the blocks which form the lowermost tier of a retaining wall and that the top knobs 23 may be omitted from the blocks which form the uppermost tier of the retaining wall. If the retaining wall is to have a vertical face, the knobs 23 and the groove 24 will have the same spacing from the face 16. If the face of an upper tier is to be offset behind the face of an adjacent lower tier, the knobs 23 on the lower tier will be spaced further from the face of the blocks in the lower tier than the spacing of the groove 24 from the face of the blocks in the upper tier. Other known techniques may be used to prevent blocks in an upper tier from shifting relative to an adjacent lower tier of blocks.

According to the invention, a groove 25 is formed in the block top 19 to extend substantially parallel to either the block face 16 or to the block rear 21 to the rear of the knobs 23. Preferably, a top rear corner 26 of the groove 25 is slightly rounded or relieved for reasons which are described below.

Figure 3:
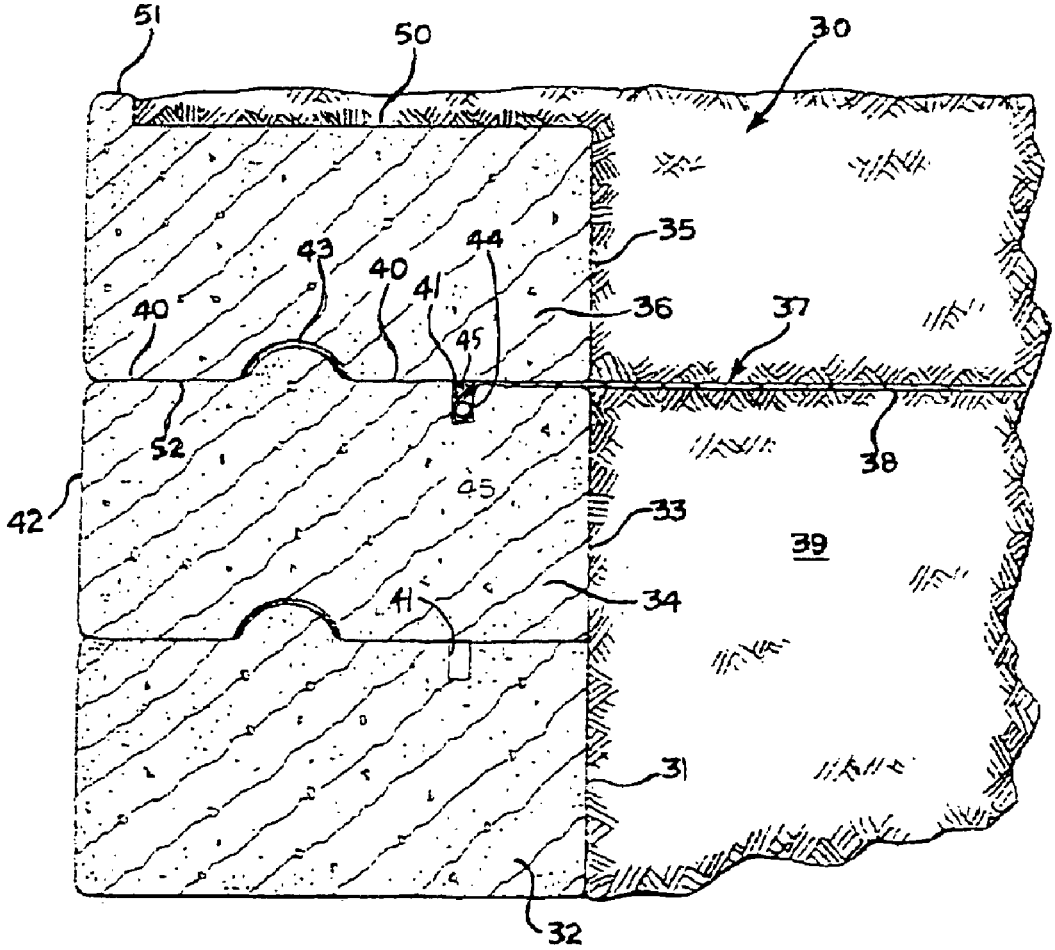
FIG. 3 is a fragmentary right end view through an exemplary three tier retaining wall with a geogrid system according to the invention connected between the second and third tiers.

FIG. 3 shows an end view of a three tier retaining wall 30 having a lower tier 31 of blocks 32, a second tier 33 of blocks 34 and an upper tier 35 of blocks 36. The retaining wall 30 is stabilized with a geogrid system 37 which includes a conventional geogrid fabric 38 secured to the wall 30 between the tiers 33 and 35. The fabric 38 is embedded in the soil 39 to the rear of the wall 30. Preferably, the fabric 38 has perforations or apertures which securely engage the soil 39 to prevent the fabric 38 from being pulled relative to the soil 39.

The geogrid fabric 39 extends over a top 40 of the block 34 and is secured in a groove 41 in the top which extends across the width of the block. If the block has a substantially flat front face 42, the groove 41 will be substantially parallel to a front face 42 of the block 34. If the block 34 is provided with top knobs 43 for aligning the tiers 33 and 35, as shown, the knobs 43 are positioned towards the front face 42 from the groove 41. If the front face 42 is not substantially flat, the groove 41 extends between left and right sides of the block and is oriented to align with similar grooves on adjacent blocks to the left and right.

Figure 4:
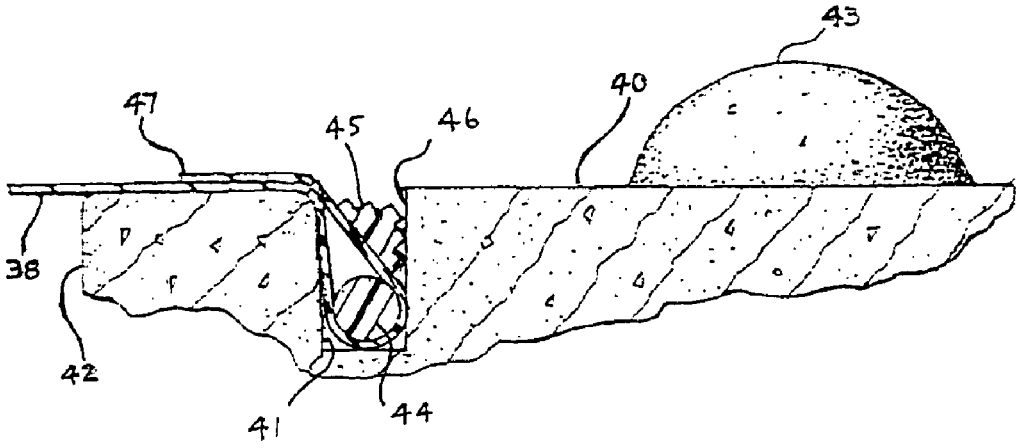
FIG. 4 is a fragmentary cross sectional view showing partial assembly of a connector according to the invention for securing a geogrid fabric to two stacked retaining wall blocks.
Figure 5:
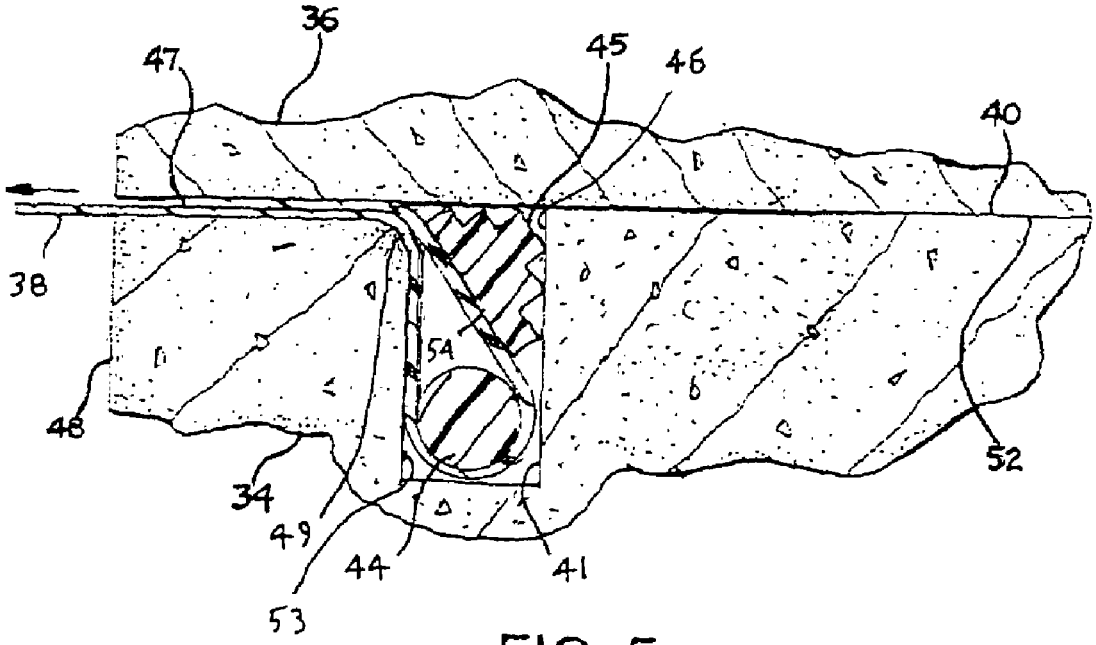
FIG. 5 is a fragmentary cross sectional view of the assembly of FIG. 4 with an upper block positioned on an adjacent lower block to complete the connector which secures the geogrid fabric to the wall.

As best shown in FIGS. 4 and 5, a rod 44 and a wedge 45 are used to form a connection which secures the fabric 38 to the groove 41. The groove 41 is slightly wider than the diameter of the rod 44 plus twice the thickness of the fabric 38. The height of the groove 41 must be sufficient to accommodate positioning the wedge 45 above the rod 44 so that it is located below the block top 40. The groove 41 may have, for example, a height of about 2 times or greater than its width. In an exemplary block 34, a 0.5 inch in diameter rod 44 was used.

The groove 41 was formed with a width of 0.625 inch and a height of 1.25 inches and was spaced about 7 inches from a rear surface 48 of the block.

After the tier 33 is set when the wall 30 is being constructed, soil or other backfill 39 is placed behind the wall to extend substantially level with the top 40 of the block 34. The fabric 38 is then laid over the soil 39 and over at least a portion of the block top 40 to extend past the groove 41. The rod 44 is then placed over the fabric 38 and the groove 41 and the rod 44 is pressed down into the groove 41. A free end 47 of the fabric 38 extending from the groove 41 is folded back over the top 40 of the block 34 to extend towards the rear surface 48. The free end 47 may extend past the rear surface 48 and over the backfill 39. The wedge 45 is then positioned in the groove 41 on top of the fabric 38 to extend along the groove 41 between the fabric 38 and a front surface 46 of the groove 41. Preferably, an upper rear edge 49 of the groove 41 is slightly rounded or relieved to prevent the edge 49 from cutting the fabric 38 when tension is placed on the fabric 38.

The rod 44 and the wedge 45 may be formed from any suitable material which will not deteriorate over time and which will not fail under stresses on the fabric 38. For example, they may be formed from a strong synthetic resinous material, which may be fiber reinforced, or they may be formed from a metal. They also may be made from different types of materials. For example, the rod 44 may be a steel rebar, and the wedge 45 may be formed from a glass fiber reinforced plastic. If the rod 44 and wedge 45 are exposed, for example, to salt water, it is preferable that they be made from a synthetic resinous material which will not deteriorate from the salt. If a rod 44 or a wedge 45 is not sufficiently long to extend across the tier 33, two or more rod and wedges may be positioned end to end in the grooves 41 which extend across the tier. If the wall 30 is curved or if the blocks are of irregular size, the rods 44 and the wedges 45 may be bent to follow the wall, or the rods 44 and wedges 45 may be cut to the length of each block groove 41.

After the fabric 38, the rods 44 and the wedges 45 are positioned in the grooves 41 for the blocks forming the tier 33, the blocks 36 are positioned on top of the tier 33 to construct the upper tier 35. If desired, the blocks 36 may have an upper surface 50 which is recessed below an upper front edge of the blocks 36 so that the soil 39 can extend over the top of the blocks 36. The blocks 36 have a lower surface 52 which rests on the blocks 34. The lower surface 52 covers the groove 41. To the rear of the groove 41, the fabric 38 and the fabric end 47 are pinched between the blocks 34 and 36. As a consequence, any force on the fabric 38 attempting to pull the fabric 38 from between the blocks the rod 44 will be pulled upwardly in the groove 41. As the rod 44 is pulled upward, the wedge 45 is moves into contact with the upper block surface 52. A rear surface 53 of the groove 41 and a surface 54 on the wedge 45 form an upwardly narrowing angled area into which the rod 44 and fabric 38 are drawn. This increases the frictional force between the fabric 38, the rod 44 and the surfaces 53 and 54, thereby preventing further movement of the fabric 38.

The wedge 45 is illustrated as having in cross section stepped or serrated sides 55 and 56 for engaging the front surface 46 of the groove 41 and the lower surface 52 of the adjacent upper block 36, respectively. It should be appreciated that the wedge 45 may have other configurations in cross section, such as rectangular or triangular. The most important aspect of the wedge 45 is that as a force pulling on the fabric 38 lifts the rod 44 and surrounding fabric 38 in the groove 41, the rod 44 becomes tightly wedged between the groove wall 54 and the wedge surface 54.

It should be appreciated that the invention is applicable to wall blocks having shapes differing from the exemplary block 11. The blocks must have sufficiently flat, parallel top and bottom surfaces so that they may be stacked to form a retaining wall with a groove extending along at least a portion of the blocks in a tier for securing to a geogrid fabric if the geogrid fabric is to be secured along the length of a tier. Alternately, if top grooves on some or all of the adjacent blocks do not align, a separate piece of geogrid fabric may be secured to one or more selected blocks rather than to an entire tier of blocks.

An advantage of the geogrid connector is that under load on the geogrid fabric 38, the rod 44 exerts a force against the wedge 45 which creates a horizontal pressure against the sides 46 and 53 of the groove 41. As a consequence, the effectiveness of the connector is less dependent on the weight of the above block 36 and works better for securing the fabric 38 near the top of a wall and in seismic conditions. A second advantage is that the connector is easier and faster to install than many prior art geogrid connector systems. A third advantage is that the rod 44 and the wedge 45 may be made from glass fiber reinforced plastic and will not rust in salt applications. Prior art geogrid connectors were made from metal which deteriorated when subjected to salt.

It will be appreciated that various modifications and changes may be made to the above described preferred embodiment of a retaining wall anchor system without departing from the scope of the following claims.

The invention claimed is:

1. An earth retaining wall comprising at least one first block having a front, a top, and a rear, and at least one second block stacked on said first block having a bottom positioned over at least a portion of said top of said first block, said first block having a longitudinal groove extending laterally across said top, said groove having a depth greater than a front to back width, said bottom of said second block closing at least a portion of said groove, said groove having a front and a rear, an elongated rod positioned in said groove, an elongated wedge positioned in said groove above said rod, and a geogrid fabric embedded in backfill behind said retaining wall and extending between said first and second blocks to said groove, into said groove, around said rod, between said rod and said wedge to the rear of said wedge and from said groove between said first and second blocks in a direction towards said rear.

2. An earth retaining wall, as set forth in claim 1, and wherein said rod has a predetermined diameter, wherein said geogrid fabric has a predetermined thickness, and wherein the width of said groove is greater than said predetermined diameter plus twice said predetermined thickness.

3. An earth retaining wall, as set forth in claim 2, and wherein said groove has a depth of at least twice the width.

4. An earth retaining wall, as set forth in claim 3, and wherein said wedge is generally triangular in cross section.

5. An earth retaining wall, as set forth in claim 1, and wherein said rod and said wedge are formed from a glass fiber reinforced synthetic resinous material.

6. An earth retaining wall, comprising at least one first block having a front, a top, and a rear, and at least one second block stacked on said first block having a bottom positioned over at least a portion of said top of said first block, said first block having a longitudinal groove extending laterally across said top, said bottom of said second block closing at least a portion of said groove, said groove having a front, a rear spaced from said front by a width, and a depth of at least twice the width, an elongated rod positioned in said groove, an elongated wedge which is generally triangular in cross section positioned in said groove above said rod, and a geogrid fabric embedded in backfill behind said retaining wall and extending between said first and second blocks to said groove, into said groove, around said rod, between said rod and said wedge and from said groove between said first and second blocks in a direction towards said rear and wherein said wedge has a first side which abuts a front side of said groove, second side which abuts the bottom of said at least one second block, and a third side which abuts said geogrid fabric, and wherein said first and second sides of said wedge each include at least one stepped projection.

7. An earth retaining wall, as set forth in claim 6, and wherein said rod and said wedge are formed from a glass fiber reinforced synthetic resinous material.

8. A method for securing a geogrid fabric to a retaining wall formed from at least two stacked concrete blocks, a lower one of said blocks having a front, a top surface, two sides, a rear and a groove in said top having a predetermined width and a predetermined depth greater than said predetermined width, said groove extending between said two sides in a direction generally parallel to said front, said groove having a front side and a rear side, and an upper one of said blocks having a bottom, said method comprising the steps of:

a) placing the geogrid fabric to extend from the rear of said lower block to extend over at least a portion of said top and over said groove;

b) placing a rod having a diameter less than said predetermined width in said groove above said geogrid fabric;

c) folding an end portion of said geogrid fabric around said rod to extend past said groove towards said rear of said first block;

d) placing a wedge in said groove above said folded end portion of said geogrid fabric and against said front of said groove; and e) placing said upper block on top of at least a portion of said lower block to cover at least a portion of said groove to confine said rod and said wedge in said groove, wherein said wedge forms an upwardly narrowing opening for said geogrid fabric in said groove.

9. A method for securing a geogrid fabric to a retaining wall, as set forth in claim 8, and wherein portions of two upper blocks are placed over said groove to confine said rod and said wedge in said groove.

10. A method for securing a geogrid fabric to a retaining wall formed from a plurality of first concrete blocks arranged in a lower tier of said retaining wall, said first blocks each having a front, a groove having a predetermined width and a predetermined depth greater than said predetermined width in a top aligned with the groove in adjacent first blocks to form a channel extending along said lower tier, and a plurality of second blocks each having a bottom, said method comprising the steps of:

a) placing the geogrid fabric to extend from the rear of said lower tier to over at least a portion of the top of at least a portion of said blocks in said lower tier and over said channel;

b) placing at least first and second rods having a diameter less than said predetermined width end to end in said channel above said geogrid fabric;

c) folding an end portion of said geogrid fabric around at least one of said rods to extend past said channel towards said rear of said first block;

d) placing a wedge in said channel above said folded end portion of said geogrid fabric, said wedge extending towards the front of said channel from said geogrid fabric; and e) placing said second blocks on top of said first blocks to cover at least a portion of said channel to confine said first and second rods in said channel.

* * * * *